US009238780B2

(12) United States Patent
Bisht et al.

(10) Patent No.: US 9,238,780 B2
(45) Date of Patent: Jan. 19, 2016

(54) SOLVENT EXTRACTION PROCESS FOR REMOVAL OF NAPHTHENIC ACIDS AND CALCIUM FROM LOW ASPHALTIC CRUDE OIL

(71) Applicant: Reliance Industries Limited, Maharashtra (IN)

(72) Inventors: Harender Bisht, Uttarakhand (IN); Asit Kumar Das, Faridabad (IN); Bibeka Hazarika, Assam (IN); Biswajit Shown, West Bengal (IN); D. P. S. Rana, Up (IN); Mahesh G. Marve, Maharashtra (IN); Manthan A. Malvanker, Gujarat (IN); Paras N. Shah, Gujarat (IN); Rohit R. Irabatti, Maharashtra (IN); Sukumar Mandal, Haryana (IN); Suyog S. Salgarkar, Maharashtra (IN)

(73) Assignee: Reliance Industries Limited, Mumbai (IN)

( * ) Notice: Subject to any disclaimer, the term of this patent is extended or adjusted under 35 U.S.C. 154(b) by 277 days.

(21) Appl. No.: 13/767,369

(22) Filed: Feb. 14, 2013

(65) Prior Publication Data

US 2013/0213857 A1 Aug. 22, 2013

(30) Foreign Application Priority Data

Feb. 17, 2012 (IN) ..... 441/MUM/2012

(51) Int. Cl.

| | |
|---|---|
| ***C10G 53/04*** | (2006.01) |
| ***C10G 53/02*** | (2006.01) |
| ***C10G 21/00*** | (2006.01) |
| ***C10G 21/14*** | (2006.01) |
| ***C10G 31/06*** | (2006.01) |
| ***C10G 53/06*** | (2006.01) |

(52) U.S. Cl.

CPC ..... *C10G 21/14* (2013.01); *C10G 21/00* (2013.01); *C10G 31/06* (2013.01); *C10G 53/06* (2013.01)

(58) Field of Classification Search

CPC ..... C10G 21/00; C10G 21/14; C10G 31/06; C10G 53/04; C10G 53/06

See application file for complete search history.

(56) References Cited

U.S. PATENT DOCUMENTS

| | | | | |
|---|---|---|---|---|
| 1,948,296 | A | | 2/1934 | Haylett |
| 1,948,596 | A | | 2/1934 | Ross |
| 2,002,004 | A | | 5/1935 | Gards |
| 2,101,308 | A | | 12/1937 | Bray et al. |
| 2,143,882 | A | | 1/1939 | Keith, Jr. et al. |
| 2,587,643 | A | | 3/1952 | Myers |
| 2,770,580 | A | | 11/1956 | Honeycutt et al. |
| 2,795,532 | A | | 6/1957 | Honeycutt |
| 2,882,219 | A | | 4/1959 | Johnson |
| 3,074,882 | A | | 1/1963 | Gross et al. |
| 3,278,415 | A | | 10/1966 | Doberenz et al. |
| 3,331,394 | A | | 7/1967 | Hefler et al. |
| 4,290,880 | A | | 9/1981 | Leonard |
| 4,298,456 | A | | 11/1981 | Coombs et al. |
| 4,443,609 | A | | 4/1984 | Oude Alink et al. |
| 4,502,950 | A | * | 3/1985 | Ikematsu et al. ..... 208/309 |
| 4,661,241 | A | * | 4/1987 | Dabkowski et al. ..... 208/131 |
| 4,715,946 | A | | 12/1987 | Le Page et al. |
| 4,778,589 | A | | 10/1988 | Reynolds |
| 4,941,994 | A | | 7/1990 | Zetlmeisl et al. |
| 5,000,838 | A | | 3/1991 | Bartilucci et al. |
| 5,078,858 | A | | 1/1992 | Hart et al. |
| 5,182,013 | A | | 1/1993 | Petersen et al. |
| 5,192,421 | A | | 3/1993 | Audeh et al. |
| 5,252,254 | A | | 10/1993 | Babaian-Kibala |
| 5,660,717 | A | | 8/1997 | Lindemuth |
| 5,928,501 | A | | 7/1999 | Sudhakar et al. |
| 5,961,821 | A | | 10/1999 | Varadaraj et al. |
| 6,086,751 | A | | 7/2000 | Bienstock et al. |
| 6,599,949 | B2 | | 7/2003 | Varadaraj et al. |
| 6,679,987 | B1 | | 1/2004 | Blum et al. |
| 6,905,593 | B2 | | 6/2005 | Kuehne et al. |
| 7,497,943 | B2 | | 3/2009 | Nguyen et al. |
| 7,749,374 | B2 | * | 7/2010 | Bhan et al. ..... 208/123 |
| 2003/0121828 | A1 | | 7/2003 | Jacobson et al. |
| 2008/0272061 | A1 | | 11/2008 | Hart et al. |
| 2009/0301931 | A1 | | 12/2009 | Koseoglu et al. |
| 2010/0089797 | A1 | | 4/2010 | Chakka et al. |
| 2010/0163457 | A1 | | 7/2010 | Subramaniyam |
| 2010/0234247 | A1 | | 9/2010 | Varadaraj |
| 2010/0252483 | A1 | | 10/2010 | Koseoglu |

FOREIGN PATENT DOCUMENTS

| | | | |
|---|---|---|---|
| GB | 666215 | A | 2/1952 |
| WO | WO-2005066301 | A2 | 7/2005 |
| WO | WO-2009058263 | A1 | 5/2009 |
| WO | WO-2009085131 | A1 | 7/2009 |
| WO | WO-2010044987 | A2 | 4/2010 |
| WO | WO-2010117403 | A1 | 10/2010 |
| WO | WO-2010118498 | A1 | 10/2010 |
| WO | WO-2010119417 | A1 | 10/2010 |
| WO | WO-2010121343 | A1 | 10/2010 |

OTHER PUBLICATIONS

Parkash, S, Refining Processes Handbook, 2003, Gulf Publishing, pp. 176-209.*

Extended European Search Report regarding Application No. 13155291.1-1361, dated Jun. 5, 2013.

* cited by examiner

*Primary Examiner* — Renee E Robinson
*Assistant Examiner* — Derek Mueller
(74) *Attorney, Agent, or Firm* — Harness, Dickey & Pierce, P.L.C.

(57) ABSTRACT

The present disclosure provides a process for obtaining extracted crude oil (ECO) which is substantially free of naphthenic acids, calcium and other impurities from low asphaltic crude oils or their residue fractions by preferential extraction of saturates using at least one solvent.

4 Claims, No Drawings

SOLVENT EXTRACTION PROCESS FOR REMOVAL OF NAPHTHENIC ACIDS AND CALCIUM FROM LOW ASPHALTIC CRUDE OIL

CROSS-REFERENCE TO RELATED APPLICATION

This application claims the benefit and priority of Indian Application No. 441/MUM/2012, filed Feb. 17, 2012. The entire disclosure of the above application is incorporated herein by reference.

FIELD OF THE DISCLOSURE

The present disclosure relates to a process for removal of naphthenic acids, calcium and other impurities from low asphaltic whole crude oils or their residue fractions.

BACKGROUND

High TAN (Total Acid Number) crudes are difficult to process due to the inherent corrosion problems associated with them. Furthermore, the high naphthenic acid content in these crudes causes serious problems in desalter which leads to tight emulsion formation, more rag layer generation and incomplete separation of crude oil from wash water. This not only creates problem for processing of such crudes in downstream units but poses serious challenge for effluent treatment plant also.

Crude containing high calcium are also very difficult to process due to increase in current drawn in desalter electrostatic grid, fouling of crude preheat trains and downstream units. Calcium deposits in shell and tube of heat exchangers drastically reduce their efficiency. Calcium acts as poison to hydrotreating and FCC (fluid catalytic cracking) catalysts. Higher calcium content in vacuum residue can cause reduction of run length in delayed coker furnaces. Further, highly paraffinic crudes have problem of high pour point, higher viscosity and poor asphaltene stability. Some of the crude oils have combination of high paraffinicity, high TAN and high calcium, hence are extremely difficult to process.

High acid crude (HAC) processing has drawn considerable attention of refiners as processing of these crudes can improve the refinery profit margins if the desalter and corrosion problems associated with them are taken care of. Various methods are disclosed in the prior art to overcome the problems/difficulties associated with HAC processing. Mainly, there are two approaches to tackle the corrosion problem in high acid crude processing. First is to make the metal surface resistant to naphthenic acid corrosion either by selecting a superior metallurgy or by use of corrosion inhibitor. The second approach is to neutralize/convert the corrosive naphthenic acids in to non-corrosive products/salts. As per the first approach, several patent documents (U.S. Pat. No. 5,182,013, U.S. Pat. No. 5,252,254, U.S. Pat. No. 4,443,609, U.S. Pat. No. 4,941,994 and WO2010/119417) in the prior art explain the use of corrosion inhibitors to reduce the naphthenic acid corrosion during processing of HAC oils. However, use of corrosion inhibitor does not address other problems associated with high naphthenic acid crude processing like poor desalter performance, higher rag layer generation and the like. To tackle the corrosion issue by the second approach, prior art discloses several methods for conversion of corrosive naphthenic acids into non-corrosive products. WO/2010/121343A1 discloses the use of microorganisms (biocatalysts), or catalysts derived from these organisms (enzymes) to improve the quality of crude oil. WO/2010/118498 discloses a process for decreasing the acidity of an acidic crude oil which involves contacting an acidic crude oil with a mixture nitrogen containing compounds and in the presence of lipase enzyme.

Further, WO/2010/117403 discloses a method for thermal cracking of organic acid containing hydrocarbon feed for removal of naphthenic acids. U.S. Pat. No. 6,086,751 discloses reduction of TAN by thermal treatment. US patent application No. 20100234247 discloses a method for removal of naphthenic acid and asphaltenes using an aqueous gel. U.S. Pat. Nos. 2,795,532 and 2,770,580 discloses use of sodium hydroxide or potassium hydroxide to neutralize the naphthenic acid. U.S. Pat. No. 5,961,821 explains neutralization of high acid crudes with ethoxylated amine. U.S. Pat. No. 6,679,987 teaches use of calcium oxide or calcium hydroxide for neutralization of high acid crudes. Neutralization of naphthenic acid with base increases its hydrophilicity and thus increases the emulsion forming tendency. Consequently, demulsifier is to be used for breaking of tight emulsion if neutralization method is employed for high naphthenic acid crude processing. U.S. Pat. No. 6,599,949 teaches use of demulsifier for better separation of crude and wash water in desalter.

The prior art patent documents do not however teach a process which allows processing of high acid crude oils wherein the naphthenic acids are removed from the crude oil without any chemical treatment and/or high temperature operation. Further, processing of crudes oils having high calcium content poses serious operation problems like high current drawn in desalter grid, fouling and scaling of exchangers, coking in furnaces, poisoning of catalysts and the like. To overcome these problems, various calcium removal agents are employed to reduce the calcium content in high calcium containing crudes before desalting and distillation. Most of these calcium removing agents are organic acids. U.S. Pat. Nos. 4,778,589 and 5,078,858 teach the use of citric acid as calcium removing agent. U.S. Pat. No. 6,905,593 discloses the use of acetic acid as calcium removal agent. U.S. Pat. No. 5,660,717 discloses the uses of functionalized polyacrylic acid for removal of calcium from crude oils. U.S. Pat. No. 7,497,943 discloses the use of a-hydroxy carboxylic acid for removal of calcium from crude oils. These calcium removing agents if not removed completely from the crude oil during desalting lead to high corrosion as they are acidic compounds. Furthermore, the removal efficiency decreases with increase in calcium content of the crude oil. Twice the stoichiometric amount of organic acid is needed for each calcium cation. At higher calcium concentration, the calcium salt of removing agent become less soluble in the aqueous phase and hence their carry over with the crude oil increases.

Solvent deasphalting is a well known technique for reduction of asphaltene in atmospheric residues and vacuum residues of crude oils containing significant amount of asphaltenes. Removal of asphaltenes leads to reduction in CCR, sulfur, Nitrogen, Ni and V content as most of these impurities in crude oil are associated with asphaltenes. A wide range of deasphalting techniques are covered in the prior art documents wherein the process conditions such as extraction temperature (WO 2009/085131 A1), solvent type (U.S. Pat. No. 1,948,296), solvent to oil ratio (U.S. Pat. No. 4,290,880), use of additive with the deasphalting solvent (U.S. Pat. No. 2,587,643, U.S. Pat. No. 2,882,219, U.S. Pat. No. 3,278,415, U.S. Pat. No. 3,331,394), two step extraction (U.S. Pat. No. 2,002,004, U.S. Pat. No. 2,101,308, U.S. Pat. No. 3,074,882), type of mixing (WO 2010/044987 A2), type of contactor (US 2010/0089797 A1), contact time (US2003/0121828 A1) have been discussed in details. There are several prior art patent documents wherein the improvement in deasphalted oil (DAO) in terms of reduction in metal viz. Ni & V (U.S. Pat. No. 5,000,838, U.S. Pat. No. 4,290,880, U.S. Pat. No. 4,298,456), CCR (WO 2009/058263 A1), Sulfur (US 2009/0301931 A1), Nitrogen (US20100252483) have been disclosed. Very few patents disclose deasphalting of whole crudes. U.S. Pat. No. 4,715,946 discloses a deasphalting process of whole crude oil comprising asphaltene content of 24.1 wt % (C5 asphaltene) and 13.6 wt % (C7 asphaltene). The deasphalting process as disclosed in aforementioned US patent also include a method step of treating hydrocarbonaceous feed stream with a solvent at a temperature between 100-220° C. and at a pressure of in the range of 4-5 MPa. The process as taught in U.S. Pat. No. 4,715,946 does not disclose reduction of naphthenic acid and/or calcium from the hydrocarbon charge.

U.S. Pat. No. 5,192,421 discloses deasphalting of whole crude However, the crude oils used in the U.S. Pat. No. 5,192,421 contains very high asphaltene content (>14 wt %) and is heavy in nature having API<20. All the examples in prior art teach the solvent deasphalting of crude oils or their residues having significant amount of asphaltenes. All the prior art related to deasphalting teach that most of the impurities like metal, sulfur and nitrogen are generally associated with the asphaltene fractions. Therefore, removal of asphaltenes will remove these impurities and improve the quality of DAO. Aforesaid patent does not disclose reduction of impurities like naphthenic acids and calcium from low asphaltic crude oils (Ashpaltene content <5 wt %).

U.S. Pat. No. 5,928,501 teaches a method for simultaneous removal of naphthenic acid and sulfur from whole crude oil, wherein the asphaltene content in the whole crude oil is 2% heptane insolubles. However, U.S. Pat. No. 5,928,501 is silent on removing calcium and naphthenic acid simultaneously.

US20100163457 discloses removal of calcium from calcium naphthenate. However, US20100163457 is silent on removal of naphthenic acid and other impurities such as vanadium, nickel, sulfur, nitrogen and Conradson Carbon Residues (CCR).

Accordingly, it is desirable to provide a method to reduce the two very important impurities i.e. naphthenic acids and calcium along with other impurities (Ni, V, S, N and CCR) of whole crude oils having very low asphaltenes.

OBJECTS

Some of the objects of the present disclosure which at least one embodiment herein satisfies:

It is an object of the present disclosure to provide a process for obtaining extracted crude oil (ECO) which is substantially free of naphthenic acids, calcium and other impurities from low asphaltic crude oils or their residue fractions.

It is an object of the present disclosure to provide an extracted crude oil (ECO) which is substantially free of naphthenic acids, calcium and other impurities such as nickel, sulphur, nitrogen, CCR and vanadium.

It is an object of the present disclosure to provide an extracted crude oil (ECO) which is capable of being directly processed as a feed stock in a hydrocracker or a FCC without prior distillation and without admixing it with an agent selected from the group consisting of corrosion inhibitors, calcium removing agents and antifoulant additives.

SUMMARY

In accordance with the present disclosure there is provided a process for obtaining extracted crude oil (ECO) which is substantially free of naphthenic acids, calcium and other impurities from low asphaltic crude oils or their residue fractions; said process comprising the following steps:

a) subjecting the low asphaltic crude oil to preferential extraction of saturates using at least one solvent by vigorously mixing the low asphaltic crude oil in at least one form selected from the group consisting of low asphaltic crude oil as such, atmospheric residue of low asphaltic crude oil and vacuum residue of low asphaltic crude oil to obtain a mixture;

b) heating the mixture and allowing the heated mixture to settle under gravity to obtain a biphasic mixture with a top layer containing extracted crude oil and solvent and a bottom layer with raffinate containing naphthenic acid, calcium and other impurities;

c) separating the top layer from the biphasic mixture; and d) heating the separated top layer to separate the solvent from the extracted crude oil to obtain solvent free extracted crude oil (ECO), said solvent free extracted crude oil being characterized by TAN percentage reduction ranging between 25 to 100%, calcium percentage reduction ranging between 40 to 99%, nickel percentage reduction ranging between 75 to 95%, vanadium percentage reduction ranging between 65 to 95%, sulphur percentage reduction ranging between 2 to 45%, nitrogen percentage reduction ranging between 25 to 50% and CCR percentage reduction ranging between 75 to 97%; said % reductions being calculated on the basis of the respective proportions of these impurities in the crude oil which is the starting material as employed in method step a.

In accordance with one of the embodiments of the present disclosure the solvent is at least one selected from the group consisting of C3 to C7 paraffins.

In accordance with another embodiment of the present disclosure the solvent further comprises at least one solvent selected from the group consisting of C3 to C7 olefins, C3 to C7 ketones, C3 to C7 ethers and C3 to C7 alcohols; the proportion of paraffins in said solvent being in the range of 70 to 100 wt %.

Typically, the mixture is heated at a temperature ranging between 50 to 140° C. and at a pressure ranging between 4 to 50 kg/cm$^2$.

Typically, the mixture is allowed to settle for a time period ranging between 30 to 300 minutes.

Typically, the method step a and b are carried out in an apparatus selected from the group consisting of a mixer settler, a batch multistage liquid-liquid extractor, a continuous multi-stage extractor and the likes.

Typically, the heating of the top layer is carried out at a temperature ranging between 50 to 60° C. and at a pressure of 0.1 to 10 Kg/cm$^2$.

In accordance with another embodiment of the present disclosure the process further comprises recovering the solvent separated in method step d and recycling it in method step a.

Typically, the bottom layer with raffinate containing naphthenic acid, Ca and other impurities is sent to a coker or a thermal cracking unit for further processing.

In accordance with another aspect of the present disclosure there is provided an extracted crude oil (ECO) capable of being directly processed as a feed stock in a hydrocracker or a FCC without prior distillation and without admixing it with an agent selected from the group consisting of corrosion inhibitors, calcium removing agents and antifoulant additives, obtained by the process of the present disclosure.

Typically, the extracted crude oil (ECO) of the present disclosure is substantially free of naphthenic acids, calcium and other impurities selected from the group consisting of nickel, sulphur, nitrogen, CCR and vanadium.

DETAILED DESCRIPTION

Some of the crude oils have combination of high paraffinicity, high TAN and high calcium, hence they are extremely difficult to process. The present disclosure provides a solvent extraction process for refining of low asphaltic crude oils having very high TAN and calcium.

In accordance with the present disclosure there is provided a process for obtaining extracted crude oil (ECO) which is substantially free of naphthenic acids, calcium and other impurities from low asphaltic crude oils or their residue fractions by preferential extraction of saturates using at least one solvent.

The process of the present disclosure offers flexibility in terms of the selection of the starting material. i.e., low asphaltic crude oils having very high TAN and calcium. Apart from the crude oil as such, the atmospheric and vacuum residues of such crude oils or a combination of these can be used as the starting material.

The starting material of the type mentioned above is vigorously mixed with at least one solvent in an apparatus such as mixer settler or batch multistage liquid-liquid extractor or continuous multistage liquid-liquid extractor and the like. The solvent employed in accordance with the process of the present disclosure is selected from the group that includes C3 to C7 paraffins. In another embodiment, a mixture of paraffins with oxygen/olefin containing solvents that include C3 to C7 olefins, C3 to C7 ketones, C3 to C7 ethers, C3 to C7 alcohols. The proportion of paraffins in such mixtures is typically in the range of 70 to 100 wt %.

The mixture of the solvent/s and the crude oil thus obtained is heated at a temperature ranging between 50 to 140° C. and at a pressure ranging between 4 to 50 kg/cm$^2$. The heated mixture is then allowed to settle for a time period ranging between 30 to 300 minutes to obtain a biphasic mixture. The top layer of such biphasic mixture contains extracted crude oil and the solvent while the bottom layer contains raffinate with naphthenic acid, calcium and other impurities.

The top layer from the biphasic mixture is separated and heated at a temperature ranging between 50 to 60° C. and at a pressure of 0.1 to 10 Kg/cm$^2$ to obtain solvent free extracted crude oil (ECO) which is analyzed for checking the presence of various impurities. The separated solvent is recovered and is recycled in the initial step of vigorous mixing. It has been found that the process of the present disclosure results in significant reduction in the proportion of various impurities from the starting material. Table 1, provided here below provides the reductions in the proportions of various impurities.

TABLE NO. 1

| Sr. No | Impurity | % Reduction with respect to the proportion of the impurity in the starting material |
|---|---|---|
| 1 | TAN | 25 to 100 |
| 2 | Calcium | 40 to 99 |
| 3 | Nickel | 75 to 95 |
| 4 | Vanadium | 65 to 95 |
| 5 | Sulphur | 2 to 45 |
| 6 | Nitrogen | 25 to 50 |
| 7 | Conradson Carbon Residue (CCR) | 75 to 97 |

The bottom layer that contains the raffinate with naphthenic acid, Ca and other impurities is sent to a coker or a thermal cracking unit for further processing.

In accordance with another aspect of the present disclosure there is provided an extracted crude oil (ECO) with a very marginally higher paraffin content of about 5% with respect to the paraffin content of the starting material. It is known that the presence of the above mentioned impurities in the feedstock causes serious prejudice to overall processing partly because of their corrosive action on the equipments (metallurgical change in the equipment) and partly because of the processing difficulties resulting on account of their presence. Therefore, customarily the processing of feed-stocks with such impurities require the addition of various agents which include corrosion inhibitors, antifoulant additives as well as calcium removing agents.

The extracted crude oil (ECO) of the present disclosure is significantly free of naphthenic acids, calcium and other impurities selected from the group consisting of nickel, sulphur, nitrogen, CCR and vanadium and therefore the ECO obtained by the process of the present disclosure obviates the need for any prior treatment (e.g. distillation, chemical treatment, addition of one or more of the reagents like corrosion inhibitors, anti-foulant additives etc) and it can be directly used as a feedstock for hydrocracking or a combination of hydro-cracking and FCC.

EXPERIMENTAL SETUP

Autoclave of 1.2 L capacity is used for the solvent extraction studies of whole crudes, their atmospheric residues or vacuum residues. Desired quantity of residue sample (~60 g) is taken in the autoclave. Desired amount of solvent (Propane or mixed butane) is taken in to the autoclave which is decided by the targeted solvent to oil ratio. Temperature of autoclave is increased and after reaching the desired reaction temperature, stifling is started and continued for desired interval. Then stirring and heating is stopped and the content is allowed to settle for desired time interval. Then ECO is collected in a pre-weighed glass beaker. The residue is left in the autoclave. ECO is heated in a water bath up to ~60° C. in a fume hood until no further reduction is observed in weight of beaker to ensure that it is completely solvent free. Residue is carefully collected in a separate beaker and weighed. The resulted ECO and residue are analyzed for TAN and Ca along with CCR, sulfur, nitrogen, Ni and V.

The disclosure will now be explained with the following non-limiting examples.

Examples-1

Solvent Extraction of Whole Crude 1 (C-1)

C-1 contains 1.1 ppm Ca, 102 ppm Ni and 2 ppm V. This crude oil has asphaltene content of 0.29 wt % and TAN of 0.43 mg KOH/g. 60 g of C-1 was charged in an autoclave. Solvent to oil ratio of 9.3 was maintained by adding 558 g of propane. The mixture of crude oil and propane was stirred at 1000 rpm and 75° C. for 1 hour. Autogenous pressure of 29 Kg/cm$^2$ was attained in the autoclave. After 1 hour, stifling and heating was stopped and the content was allowed to settle down for another 1 hour. 56.8 g ECO was collected slowly from the dip tube of the autoclave. The residue, sticking to the wall and stirrer of autoclave was collected and weight separately. The properties of ECO and whole crude C-1 are listed in table-1.

Examples-2

Solvent Extraction of Whole Crude 2 (C-2)

C-2 contains 13 ppm Ca, 79.3 ppm Ni, 1.9 ppm V. This crude has asphaltene content of 0.4 wt % and TAN of 3.96 mg KOH/g. 60 g of C-2 was charged in an autoclave. Solvent to oil ratio of 10.3 was maintained by adding 618 g of propane. The mixture of crude oil and propane was stirred at 1000 rpm and 75° C. for 1 hour. Autogenous pressure of 29 Kg/cm$^2$ was attained in the autoclave. After 1 hour, stifling and heating was stopped and the content was allowed to settle down for another 1 hour. 36.3 g ECO was collected slowly from the dip tube of the autoclave. The residue, sticking to the wall and stirrer of autoclave was collected and weight separately. The properties of ECO and whole crude C-2 are listed in table-1.

Examples-3

Solvent Extraction of Whole Crude 3 (C-3)

C-3 contains 238 ppm Ca, 9.3 ppm Ni and 0.6 ppm V. This crude has asphaltene content of 0.8 wt % and TAN of 4.45 mg KOH/g. 60 g of C-3 was charged in an autoclave. Solvent to oil ratio of 8.8 was maintained by adding 528 g of propane. The mixture of crude oil and propane was stirred at 1000 rpm and 75° C. for 1 hour. Autogenous pressure of 29 Kg/cm$^2$ was attained in the autoclave. After 1 hour, stifling and heating was stopped and the content was allowed to settle down for another 1 hour. 41 g ECO was collected slowly from the dip tube of the autoclave. The residue, sticking to the wall and stirrer of autoclave was collected and weight separately. The properties of ECO and whole crude C-3 are listed in table-1.

TABLE 1

Properties of low asphaltic crude oils and ECO

| Parameter | Crude-1 (C-1) | C-1 ECO | Crude-2 (C-2) | C-2 ECO | Crude-3 (C-3) | C-3 ECO |
|---|---|---|---|---|---|---|
| TAN, mg KOH/g | 0.43 | 0.15 | 3.96 | 0.8 | 4.45 | 2.5 |
| Calcium, wt ppm | 1.1 | 0.65 | 13.0 | 1.8 | 238 | 9.5 |
| Sulfur, mass % | 0.111 | 0.0935 | 0.123 | 0.12 | 0.125 | 0.11 |
| Nitrogen, mass % | 0.1384 | 0.0978 | 0.1948 | 0.0961 | 0.1409 | 0.0794 |
| CCR, mass % | 4.31 | 0.41 | 8.0 | 0.49 | 5.8 | 0.15 |
| Ni, wt ppm | 102 | 14.5 | 79.3 | 3.2 | 9.6 | 0.5 |
| V, wt ppm | 2.1 | 0.2 | 1.9 | <0.1 | 0.3 | <0.1 |
| Asphaltene Content, mass % | 0.29 | 0* | 0.4 | 0* | 0.8 | 0* |
| ECO Yield, wt % | — | 94.7 | — | 60.4 | — | 68.3 |

*Not detectable by ASTM D6560

As seen from Table-1 significant TAN and calcium reduction could be obtained due to solvent extraction of the 3 low asphaltic crude oils. Furthermore, amounts of Ni, V, sulfur, nitrogen and CCR have also significantly reduced in the ECO. Table-2 shows the saturate, aromatic, resin and asphaltene distribution of whole crude and ECO.

TABLE 2

SARA analysis of low asphaltic whole crudes and ECO

| S. No | Sample name | Saturate | Aromatic | Resin | Ashpaltene (ASTM D6560) |
|---|---|---|---|---|---|
| 1 | Whole Crude C1 | 80.8 | 10.7 | 8.2 | 0.29 |
| 2 | C1 ECO | 85.3 | 9.2 | 5.4 | 0.00 |
| 3 | Whole Crude C2 | — | — | — | 0.40 |
| 4 | C2 ECO | 84.5 | 8.5 | 7.0 | 0.00 |
| 5 | Whole Crude C3 | 56.2 | 30.2 | 12.8 | 0.80 |
| 6 | C3 ECO | 85.2 | 10.4 | 4.4 | 0.00 |

As evident from Table-1 and 2 the ECO generated after solvent extraction of the three low asphaltic crudes having high Ca, Ni and TAN is a very good feedstock for FCC. Therefore, blend of ECO of these three crude oils can be processed in FCC without any further chemical/thermal treatment and metallurgy change.

Examples-4

Solvent Extraction of Atmospheric Residue of C-1

Atmospheric residue of C-1 contains 139 ppm Ni, 3.2 ppm V, Ca 2.5 ppm and asphaltene content of 0.4 wt %. TAN of atmospheric residue of C-1 was 0.32 mg KOH/g. 60 g of atmospheric residue of C-1 was charged in an autoclave. Solvent to oil ratio of 10 was maintained by adding 600 g of propane. The mixture of crude oil and propane was stirred at 1000 rpm and 65° C. for 1 hour. Autogenous pressure of 23 Kg/cm$^2$ was attained in autoclave. After 1 hour, stirring and heating was stopped and the content was allowed to settle down for another 1 hour. 46.5 g ECO was collected slowly from the dip tube of the autoclave. The residue, sticking to the wall and stirrer of autoclave was collected and weight separately. The properties of ECO and atmospheric residue of C-1 are listed in table-3.

Examples-5

Solvent Extraction of Atmospheric Residue of C-2

Atmospheric residue of C-2 contains 15 ppm Ca, 95.5 ppm Ni, 3.5 ppm V and asphaltene content of 0.54 wt %. TAN of atmospheric residue of C-2 was 3.4 mg KOH/g. 60 g of atmospheric residue of C-2 was charged in an autoclave. Solvent to oil ratio of 9.4 was maintained by adding 564 g of propane. The mixture of crude oil and propane was stirred at 1000 rpm and 65° C. for 1 hour. Autogenous pressure of 23.7 Kg/cm$^2$ was attained in autoclave. After 1 hour, stifling and heating was stopped and the content was allowed to settle down for another 1 hour. 46.1 g ECO was collected slowly from the dip tube of the autoclave. The residue, sticking to the wall and stirrer of autoclave was collected and weight separately. The properties of ECO and AR of C-2 are listed in table-3.

Examples-6

Solvent Extraction of Atmospheric Residue of C-3

Atmospheric residue of C-3 contains 325 ppm Ca, 14.8 ppm Ni, 0.4 ppm V and asphaltene content of 1.1 wt %. TAN of atmospheric residue of C-3 was 3.14 mg KOH/g. 60 g of atmospheric residue of C-3 was charged in an autoclave. Solvent to oil ratio of 10 was maintained by adding 600 g of propane. The mixture of crude oil and propane was stirred at 1000 rpm and 65° C. for 1 hour. Autogenous pressure of 23 $Kg/cm^2$ was attained in autoclave. After 1 hour, stirring and heating was stopped and the content was allowed to settle down for another 1 hour. 46.9 g ECO was collected slowly from the dip tube of the autoclave. The residue, sticking to the wall and stirrer of autoclave was collected and weight separately. The properties of ECO and AR of C-3 are listed in table-3.

TABLE 3

Effect of solvent extraction of atmospheric residues on TAN and Ca reduction

| Parameter | C-1 AR (370° C.+) | C-1 AR ECO | C-2 AR (370° C.+) | C-2 AR ECO | C-3 AR (370° C.+) | C-3 AR ECO |
|---|---|---|---|---|---|---|
| TAN, mg KOH/g | 0.32 | 0.0 | 3.4 | 0.60 | 3.14 | 2.34 |
| Calcium, wt ppm | 2.5 | 0.5 | 15.0 | <0.1 | 325.0 | 18.6 |
| Sulfur, mass % | 0.14 | 0.11 | 0.344 | 0.189 | 0.177 | 0.147 |
| Nitrogen, mass % | 0.20 | 0.11 | 0.14 | 0.099 | 0.1482 | 0.0989 |
| CCR, mass % | 5.2 | 1.2 | 11.0 | 1.6 | 6.8 | 1.1 |
| Ni, wt ppm | 139.0 | 13.6 | 95.5 | 1.4 | 14.8 | 2.6 |
| V, wt ppm | 3.2 | 0.2 | 3.5 | <0.1 | 0.4 | <0.1 |
| Asphaltene Content, (ASTM D6560) mass % | 0.4 | 0* | 0.54 | 0* | 1.1 | 0* |
| ECO Yield, wt % | — | 77.5 | — | 45.0 | — | 78.2 |

*Not detectable by ASTM D6560

As seen from Table-3 significant TAN and calcium reduction could be obtained due to solvent extraction of atmospheric residues of the three low asphaltic crude oils. Furthermore, the amounts of Ni, V, sulfur, nitrogen and CCR have also significantly reduced in the ECO after the solvent extraction. Table-4 shows the saturate, aromatic, resin and asphaltene distribution of whole crude and ECO.

TABLE 4

SARA analysis of atmospheric residue of low asphaltic crude oils and ECO

| S. No | Sample name | Saturate | Aromatic | Resin | Ashpaltene (ASTM D6560) |
|---|---|---|---|---|---|
| 1 | C1 AR | 75.4 | 11.7 | 12.5 | 0.40 |
| 2 | C1 AR ECO | 88.7 | 9.1 | 2.2 | 0.00* |
| 3 | C2 AR | 59.8 | 22.1 | 15.5 | 0.54 |
| 4 | C2 AR ECO | 88.7 | 6.8 | 4.5 | 0.00* |
| 5 | C3 AR | 55.9 | 32.2 | 10.7 | 1.10 |
| 6 | C3 AR ECO | 73.3 | 20.5 | 6.2 | 0.00* |

*Not detectable by ASTM D6560

As evident from Table-3 and 4 the ECO generated after solvent extraction of atmospheric residue the three low asphaltic crudes having high Ca, Ni and TAN is a very good feedstock for FCC. Therefore, blend of ECO form atmospheric residues of these three crude oils can be processed in FCC without any further chemical/thermal treatment and metallurgy change.

TABLE 5

FCC Micro-reactor yields at constant plant coke with Sweet VGO and blend of VGO with C1 and ECO of C1

| Properties | FCC with sweet VGO | FCC with 88% Sweet VGO and 12% Whole crude (C1) | FCC with 88% Sweet VGO and 12% ECO for crude (C1) |
|---|---|---|---|
| Ni on catalyst, ppm | 200 | 9000 | 1500 |
| Propylene, wt % | 9.72 | 9.98 | 10.30 |
| Gasoline, wt % | 39.89 | 38.54 | 39.71 |
| Conversion, wt % | 79.26 | 77.11 | 79.85 |
| Regeneration Temperature, ° C. | 691 | 711 | 697 |

In Table-5 the yields obtained in FCC microreactor at constant coke are compared for 100% normal VGO feed, 88% VGO+12% whole crude (C1) and 88% VGO+12% ECO from C1. It is observed that the cracked product yields are significantly improved after extraction of Nickel from the whole crude by using the process described in this invention. This results in higher conversion, higher propylene and gasoline yield since the Nickel content in ECO is much lower as seen in table-1 which resulted in lower Ni content on circulating catalyst and significant lower delta coke as reflected in reduction of regenerator temperature with ECO feedstock. This example illustrates the usefulness of the present invention for processing of low asphaltic whole crude or residues thereof towards removal of impurities for cracking catalyst and its impact on FCC performance.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

Therefore, while the embodiments herein have been described in terms of preferred embodiments, those skilled in the art will recognize that the embodiments herein can be practiced with modification within the spirit and scope of the embodiments as described herein.

The invention claimed is:

1. A process for obtaining extracted crude oil (ECO) which is substantially free of impurities including naphthenic acids, calcium, nickel, vanadium, and Conradson Carbon Residue (CCR) from a starting material containing less than 1 wt. % asphaltene selected from the group consisting of low asphaltic crude oils, atmospheric residues of low asphaltic crude oils, and vacuum residues of low asphaltic crude oils; said process comprising the following steps:

a) subjecting the starting material to preferential extraction of saturates using at least one solvent by vigorously mixing the starting material with at least one solvent to form a mixture, wherein said solvent is at least one selected from the group consisting of C3 to C7 paraffins, C3 to C7 olefins, C3 to C7 ketones, C3 to C7 ethers, C3 to C7 alcohols and mixtures thereof, and, when present, the proportion of paraffins in said solvent ranges from 70 wt. % to 100 wt. %;

b) heating the mixture to a temperature in the range of 50° C. to 140° C. and at a pressure in the range of 4 $kg/cm^2$ to 50 $kg/cm^2$ and allowing the heated mixture to settle under gravity for a time period ranging between 30 to 300 minutes to obtain a biphasic mixture with a top layer containing extracted crude oil and solvent and a bottom layer with raffinate containing said impurities;

c) separating the top layer from the biphasic mixture; and d) heating the separated top layer to a temperature in the range of 50° C. to 60° C. and at a pressure in the range of 0.1 $kg/cm^2$ to 10 $kg/cm^2$ to separate the solvent from the extracted crude oil and to obtain a solvent free extracted crude oil (ECO), said solvent free extracted crude oil being characterized by a total acid number (TAN) percentage reduction ranging between 25 to 100%, calcium percentage reduction ranging between 40 to 99%, nickel percentage reduction ranging between 75 to 95%, vanadium percentage reduction ranging between 65 to 95%, sulphur percentage reduction between 2 to 45%, nitrogen percentage reduction ranging between 25 to 50% and CCR percentage reduction ranging between 75 to 97%; said percentages reductions being calculated on the basis of the respective proportions of these impurities in the starting material.

2. The process as claimed in claim 1, wherein the process steps a and b are carried out in an apparatus selected from the group consisting of a mixer settler, a batch multistage liquid-liquid extractor and a continuous multistage liquid-liquid extractor.

3. The process as claimed in claim 1, further comprising recovering the solvent separated in process step d and recycling it in process step a.

4. The process as claimed in claim 1, wherein the bottom layer with raffinate containing naphthenic acid, Ca and other impurities is sent to a coker or a thermal cracking unit for further processing.

* * * * *